United States Patent [19]

Gordon et al.

[11] 4,024,016

[45] May 17, 1977

[54] CYLINDER MOLD FORMER WITH FLOW BOX AND PRESSURE LID

[75] Inventors: John Herbert Gordon, Bradford; Frank A. Duchnowski, Lawrence, both of Mass.

[73] Assignee: J. H. Horne & Sons, Inc., Lawrence, Mass.

[22] Filed: Dec. 18, 1975

[21] Appl. No.: 642,132

[52] U.S. Cl. ..... 162/214; 162/216; 162/317; 162/343; 162/347

[51] Int. Cl.[2] ..... D21F 1/04

[58] Field of Search ..... 162/212, 214, 216, 317, 162/336, 338, 343, 347

[56] References Cited

UNITED STATES PATENTS

| | | | |
|---|---|---|---|
| 2,934,140 | 4/1960 | Goodwillie | 162/317 |
| 3,072,180 | 1/1963 | Jodrey | 162/347 X |
| 3,216,892 | 11/1965 | Wahlstrom et al. | 162/343 |
| 3,298,905 | 1/1967 | Spengos et al. | 162/336 |
| 3,486,972 | 12/1969 | Nagell | 162/343 |

FOREIGN PATENTS OR APPLICATIONS

| | | | |
|---|---|---|---|
| 2,020,693 | 11/1971 | Germany | 162/317 |

*Primary Examiner*—S. Leon Bashore
*Assistant Examiner*—Richard V. Fisher
*Attorney, Agent, or Firm*—Pearson & Pearson

[57] ABSTRACT

A former for cylinder mold, paper making, machines, of the type now known as B.R.D.A., and having a pressure lid, an explosion chamber with a central imperforate baffle, and a manifold feeding stock to the chamber is characterized by the flow box unitarily containing an explosion chamber separated from a tapered manifold by an apertured plate. Stock is directed from the plate apertures in a direction normal to the baffle for improved mixing. The pressure lid includes a forward cantilevered tip end with a predetermined tip clearance, and is unusually elongated to increase drainage effect. The lower plate of the slice is rubber with an inner bulb and it is slidable axially outward for replacement. The curvature and clearances of the lid are changeable during operation and the lid acts as an adjustable gate for controlling pooling under the lid.

17 Claims, 5 Drawing Figures

*Fig. 3.*
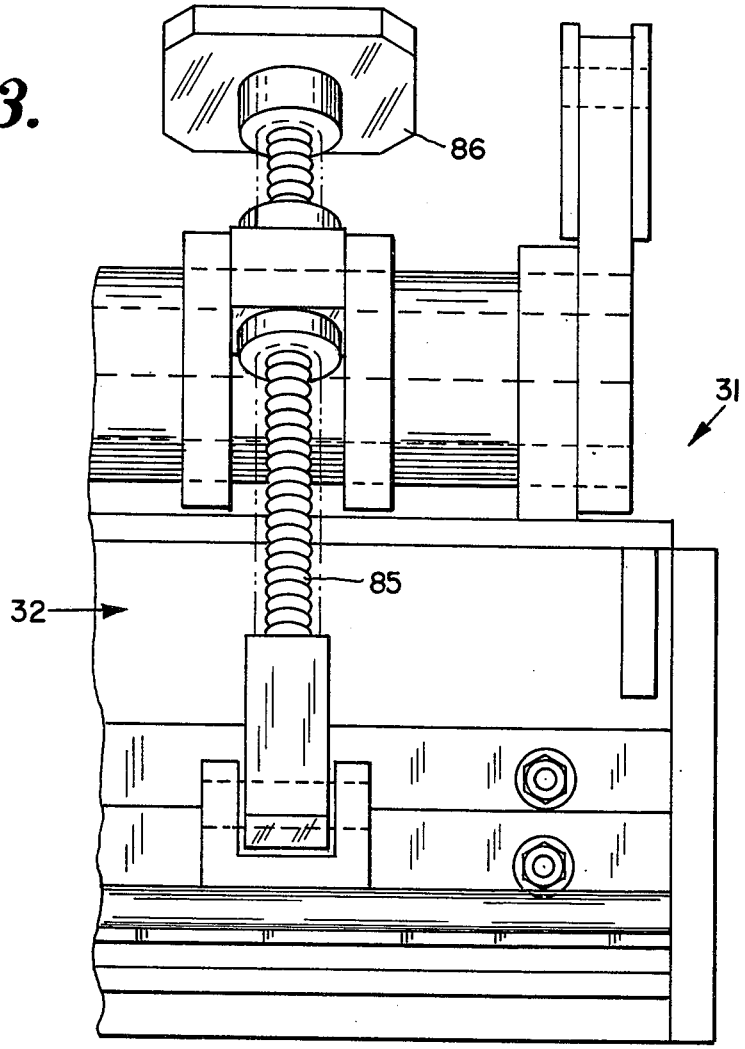
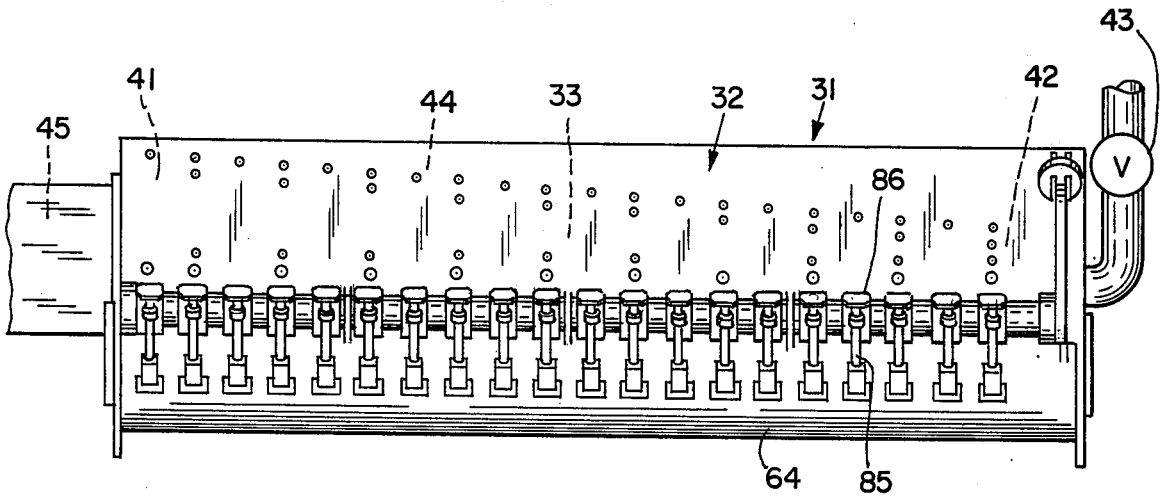
*Fig. 4.*

CYLINDER MOLD FORMER WITH FLOW BOX AND PRESSURE LID

BACKGROUND OF THE INVENTION

This application is directed to an improved embodiment of what is known in the art as a B.R.D.A. former, with which applicants are familiar. B.R.D.A. are the initials of Boxboard Research and Development Association of Kalamazoo, Mich.

It has been known to make paper on a perforated cylinder revolving in a vat. In the above mentioned B.R.D.A. former a perforated cylinder is still used, but the vat is eliminated in favor of the flow box having a pressure lid in contact with about eight inches of the cylinder mold face. The stock is collected on the face of the mold with most of the water draining through its wire face. It is most important that the fibrous component of the paper making stock be evenly dispersed with random fiber networks and no streaking or streaming or bulges in the lid. It is also important that the stock be free of local turbulence which could cause non-uniformities in the weight, thickness and appearance of the finished paper. The B.R.D.A. former utilizes a tapered flow spreader delivering stock to a set of elongated plastic tubes which enter the explosion chamber at cross angles to each other and at oblique angles to the floor of the chambr and to the face of the upstanding baffle in the chamber, all as disclosed in U.S. Pat. No. 3,565,758 of Feb. 23, 1971 and U.S. Pat. No. 3,622,450 of Nov. 23, 1971 of St. Anne's Board Mill Company Ltd., Bristol, England.

It has heretofore been proposed in U.S. Pat. No. 2,894,581 to Goumeniouk of July 14, 1959 and U.S. Pat. No. 3,328,236 to Burgess of June 27, 1967 to provide a tapered manifold of circular, or rectangular cross section which feeds stock directly to a head box by means of a bank of elongated crossed tubes. As mentioned above it has also been proposed to provide a similar tapered manifold and a bank of shorter crossed tubes to feed stock into an expansion chamber and thence into a pressure lid as in the B.R.D.A. apparatus. It has further been proposed in U.S. Pat. No. 2,929,449 to Mardon of Mar. 22, 1960 and U.S. Pat. No. 3,119,733 to Wilson of Jan. 28, 1964 to provide a tapered manifold of rectangular cross section which has an apertured plate as one wall for delivering stock through the apertures directly into a head box.

SUMMARY OF THE INVENTION

However, as far as we are aware it has not been proposed in the prior art to provide a tapered manifold with an apertured plate and to use that plate as a common wall in a unitary flow box so that the axes of the apertures are normal to the plane of an imperforate flow box baffle. Thus the tapered manifold feeds directly into the expansion, or explosion chamber of the flow box, and the complicated, costly and relatively inefficient bank of tubes is eliminated. In the flow box of this invention, the stock not only impacts the planar face of the baffle from the plate apertures in a direction normal to the plane for 360° spreading thereof but is diverted upwardly, along the imperforate baffle, and again impacts the roof, or top wall, of the expansion chamber for a second 360° spreading normal to the plane thereof before being diverted forwardly over the baffle and reaching the narrow passage of the chamber.

The pressure lid of the flow box of the invention, contrary to the teaching of the art, is usually elongated in the range of at least 12 inches and up to 18 inches or more for greater dwell time of the stock as it drains through the cylinder mold wire under pressure in the lid. The pressure lid has an integral, resilient flange hinge, and rubber cushion, connection to the flow box together with profile knob support mountings arranged to permit the increased arcuate coverage of the lid. The lid cooperates with a novel beaded rubber strip, serving as a bottom plate which slides axially outward for replacement whenever required. To correct any uneven distribution of stock through the apertures, the tapered manifold includes a top, or roof, plate insert which controls the volume within the manifold and can be easily slidably removed for remachining to vary the pressure across the apertured plate.

BRIEF DESCRIPTION OF THE DRAWING

FIG. 3 is a fragmentary front view of the former shown in FIG. 2; and

FIG. 4 is a plan view, on a reduced scale of the former; and

DESCRIPTION OF THE PREFERRED EMBODIMENT

Figure 1:
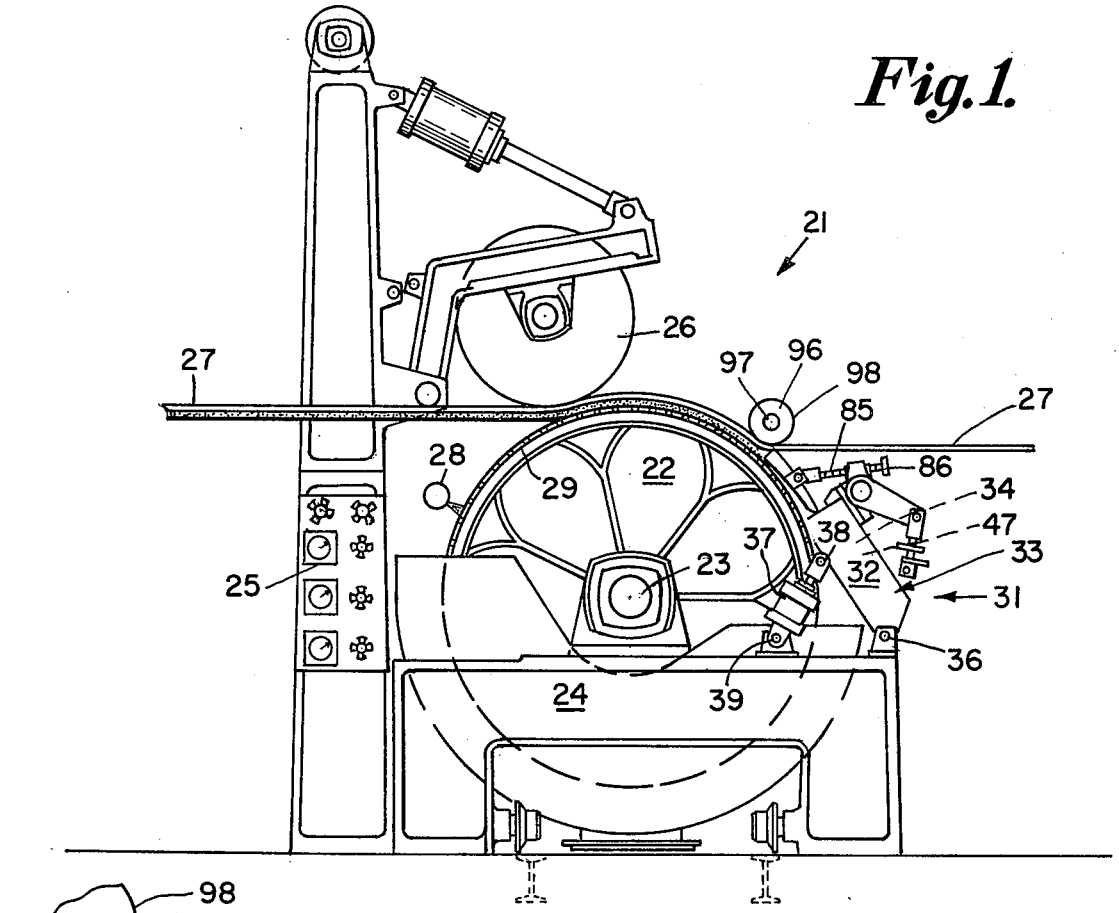
FIG. 1 is a schematic side elevational view of a typical cylinder mold with the former of the invention installed therein.
Figure 2:
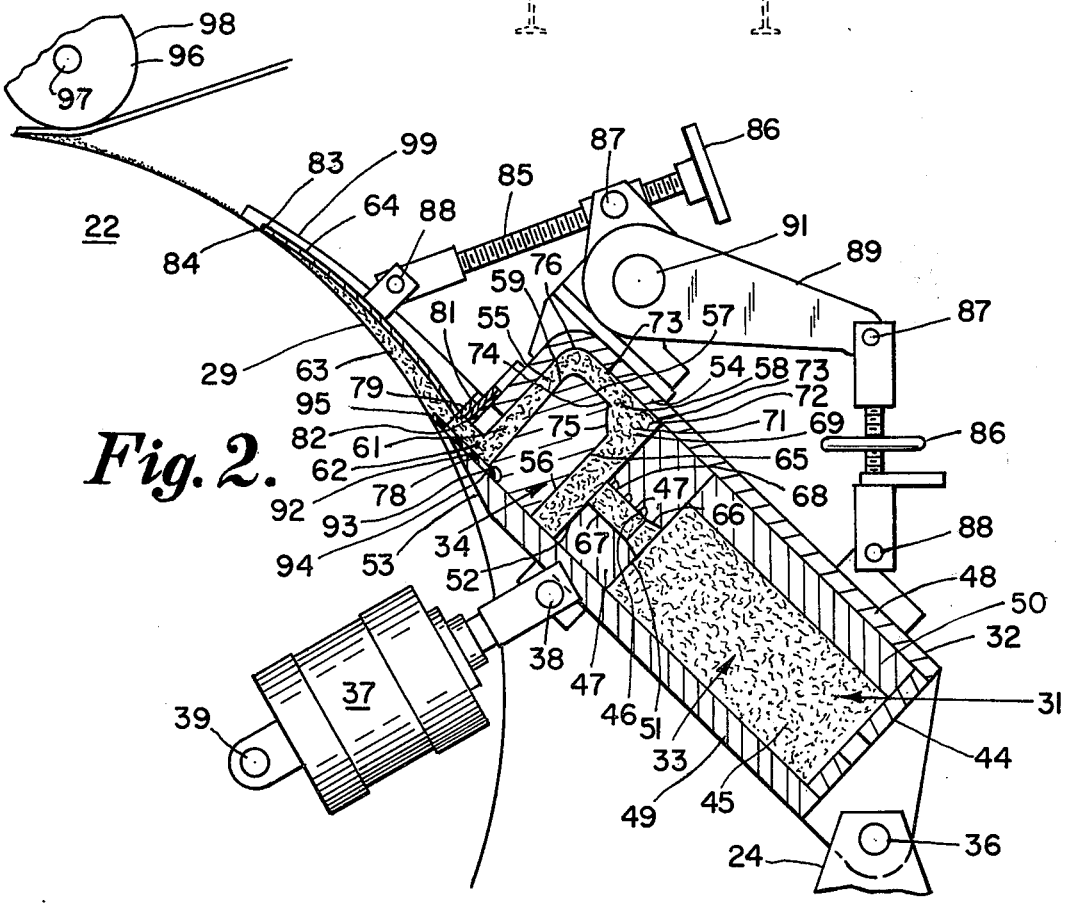
FIG. 2 is an enlarged, fragmentary, side elevational view, in section, on line 2—2 of FIG. 3.

As shown in FIG. 1, a typical cylinder mold paper making machine 21 includes a cylinder mold 22, rotatable on shaft 23 in frame 24, there being suitable controls 25, a couch roll 26, a felt 27, and shower 28 all being well known in the trade. The mold surface 29 is perforated and usually consists of a fine mesh wire, supported on a course mesh wire the latter supported on suitable axially extending rods or bars.

The former 31 of the invention comprises a unitary enclosed flow box 32, devoid of any bank of cross tubes, and having a tapered manifold 33 juxtaposed to an explosion, or expansion, chamber 34 and separated therefrom by the apertured partition 47. The unitary flow box 32 is hinge pivoted at each opposite side as at 36 to the frame 24 and supported by the fluid actuated cylinder and piston mechanism 37, preferably air, there being a pivot connection at 38 and a pivot block 39 mounted on frame 24.

The manifold 33 is preferably of rectangular cross section and tapers in the cross-machine direction from the large influent end 41 to the small effluent end 42, there being a valve 43 at the small end to permit recirculation and control of pressure within the manifold. Manifold 33 has one side wall 44 obliqued to the path of incoming stock 45, to change the direction thereof into a predetermined pattern of indentical aperatures 46 in the opposite side wall 47, there being an upper wall 48 and a parallel lower wall 49. Manifold 33 preferably includes a top insert plate 50, of predetermined dimensions to establish the volume of the manifold, the insert plate 50 being slidably removable from the large end 41 for machining and replacement.

The apertured side wall 47, constitutes a common partition separating the unitary flow box 32 into a tapered manifold 33 juxtaposed to an explosion, or expansion chamber 34; the apertures 46 extending from the inner face 51 of wall 47 to the outer face 52 thereof, face 52 also being an inner face of the explosion chamber.

The explosion chamber 34 includes the floor 53, top, or roof, wall 54, the apertured rearward sidewall 47 and the forward wall 55, there being a baffle 56 upstanding centrally from floor 53 to an upper face 57, the face 57 being at a spaced distance from top wall 54 to form a flow passage 58 of predetermined reduced dimensions called a narrow diffuser section. The forward face 59 of baffle 56 is inclined to form with the corresponding face of foward wall 55 an outwardly tapered diffuser section 61. A stock outlet 62 is formed under forward wall 55 leading to the pressure chamber 63 under the pressure lid 64.

The rearward facing face 65 of baffle 56 is imperforate vertical and planar and the axes of the apertures 46 in the wall 47 are parallel to each other and each normal to the plane of face 65 so that stock 45 emitted from the apertures will impact normal to the face 65 and spread out for 360° therearound in somewhat of a mushroom pattern thereby mixing the fibers in the stock in an unusually efficient manner.

Each aperture 46 preferably includes a truncated conical bore 66 at the influent end and a cylindrical bore 67 of reduced dimensions at the effluent end and preferably each apeture is provided with rifled grooves 68 which have been found to increase the mixing of the stock. Preferably the apertured plate 47 is of "Plexiglas", or the equivalent, with the small perforations 46 spaced evenly across the machine and designed to create a large pressure drop which ensures the same flow of stock over each perforation. The perforation length, diameter, spacing, tapering geometry and velocity ratio between the manifold 33 and perforations 46 determine the angle of taper of the manifold. The spacing of the perforations across the machine is determined by the desired pressure drop across the plate, or wall, 47 which is a function of stock 45 being used.

Stock 45 enters the expansion chamber 34 at high velocites through pertures 46 and impacts face 65 of baffle 56, which is preferably also of "Plexiglas", the impact and 360° deflection creating stable eddies thereby dissipating kinetic enerby, spreading the stock and evening out stock velocity and pressure across the flow box 32. Eddying continues as the stock flows upwardly in expansion section 69 into the right angle turn 71 which is square, with a right angular corner 72 which maximizes the pressure loss and eddying caused by passing a liquid around a 90° corner and prepares the stock for its entry into the narrow diffuser section 58. The lower face 73 of top wall 54 is flat and planar to impact the stock perpendicularly for a second time prior to entering the throat 58.

Preferably the upper rearward edge 74 of the face 57 of baffle 56 is cut away to form a convex recess 75 which is a converging entrance to the diffuser section 58 for decreasing eddying and increasing pressure. Stock then flows through the narrow passage 58 in which a sharp rise in pressure is applied to the stock in what is known as a "pressure shock". The stock then passes the second right angular turn 76 into the diverging diffuser section 61, wherein some of the kinetic energy is dissipated as adjacent layers of stock 45, near the walls 55 and 59 slide by each other. Eddies are thus reformed and turbulent mixing occurs as the stock approaches throat, or outlet, 62 and the last right angular corner 78 of the expansion chamber. The speed of the stock at this time has slowed to where it approaches the speed of rotation of the cylinder mold 22, its pressure is at a maximum, mixing subsides and the stock is ready to be laid on the mold surface 29. The stock network is set only after reaching the turn at throat 62 so that there is little possibility for stock flocculation to take place in the former 31.

The stock flow is from throat 62 leads into an enclosure 63 formed by the flexible, pressure lid 64, the lid enclosure matching the radial drainage profile of the particular mold 22 and maintaining equal pressure across the entire enclosure. The lid 64 is of flexible resilient material such as metal and extends circumferentially from an intergral upturned flange 79, fixed to the former throat opening adjustment 81 with a rubber cushion 82 therebetween, to a free terminal tip 83 and preferably covers an arc of surface 29 at least 12 inches long and up to 18 inches in length.

The clearance, or lid tip opening, 84 is adjustable by a number of fine lid tip adjustment screws 85, by means of a knob 86, the screws being located about every 6 inches parallel to the cylinder mold 22 across the machine. Lid 64 is a self adjusting spring leaf which can flex and compensate for the various basis weight sheets run on the machine. The only adjustment needed for a change of weight is to change the consistency of the stock being run through the machine. The lid 64 will also flex to pass contraries without plugging. The entire lid 64 is adjustable as a unit by means of the threaded turn knob 86, pivot connections 87 and 88, linkage 89 and shaft 91.

An axially extending strip 92, of rubber or the like has a bead, or bulb, 93 at the rearward edge seated in a corresponding groove 94 in the lower forward wall of baffle 56, and its free terminal forward tip 95 in contact with surface 29, the strip being slidable endwise out of the groove for easy replacement.

While the felt 27 would conventionally be at the level of the top of cylinder mold 22, at its approach thereto, in this invention it has been found preferable to mount a smooth faced idler roll 96 with its shaft 97 well below that level and with its surface 98 in close proximity to the tip 83 of pressure lid 62. Suitable end dams, or deckles, 99 are mounted at each opposite end of pressure lid 62 and supported on the unitary former 31, rather than being mounted on the frame 24 as in the prior art.

While, as stated above, it is usually important that the fibrous component of the paper stock be evenly dispersed with random fiber networks, an exception occurs on certain grades of board and paper. In such grades, it is essential, in order to meet test usage, and final product usage, to control the fiber orientation of the sheet.

It will be understood that as the pressure lid former of the invention flows fibrous stock onto the perforated screen surface of the cylinder, at certain relative speeds the majority of the fibres may tend to be laid parallel to the path of rotation. On the other hand, if the pressure lid is capable of adjustment from a high pressure slice effect to a slower speed stagnant pool effect, the operator is able to achieve a desired ratio of fibres lying transverse to the path.

The resulting sheet characteristic is commonly referred to by paper makers as tensile ratio, the tensile ratio depending on the machine direction to cross machine direction orientation of the fibers.

It is possible to change the degree of fiber orientation by changing the relative velocity of the surface of the cylinder and the outlfow jet emerging from the throat of the pressure lid. Thus with a given surface speed of the cylinder mold, the Machine Directional Cross/Machine Direction Tensile ration can be changed and controlled by changing and controlling the curvature and clearances of the pressure lid.

The tensile ratio gives an indication of sheet stiffness properties because the stiffness characteritics of a multiply sheet are dependent on the tensile character of the outside ply, or layer, of the multi-layer structured sheet.

Figure 5:
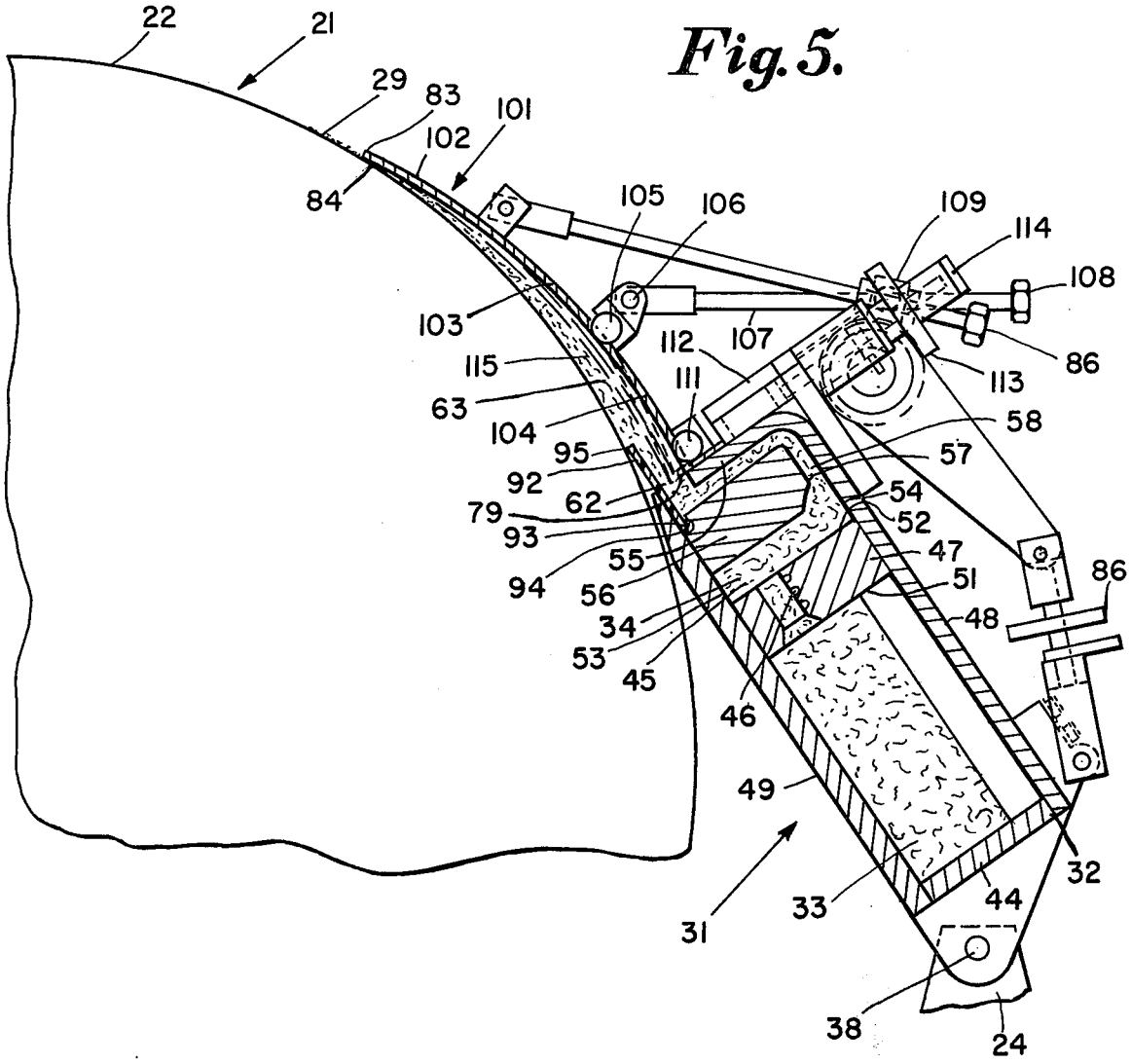
FIG. 5 is a view similar to FIG. 2 but showing the flexible, articulated pressure lid of the invention.

By means of the improved adjustable, curvature lid 101 of the invention, shown in FIG. 5, fiber orientation may be controlled so as to yield a tensile ratio in the range of approximately 1.1 to 1 to 5.1 MD/CD (Machine Direction - Cross Machine Direction). With special former designs ratios of 10 to 1 may be achieved.

The pressure lid 101, like lid 64 ranges from twelve to eighteen inches in length from the free terminal tip 83 of the cantilevered portion 102, to the upturned flange portion 79 at the stock outlet or gateway, 62. It differs from lid 64, which is unitary and of flexible, resilient metal, or equivalent material, in that it is articulated and formed of two parts 103 and 104 hingely connected at 105, by a piano hinge device or the like, the hinge 105 being connected by pivot 106, thrust screw 107 and knob 108 in a bracket 109. Similarly the rearward portion 104 is hingedly connected at 111 by a piano hinge device or the like, the hing 111 being connected to the thrust screw 112 and turn knob 113 in a bracket 114.

It will be seen that handwheels, or knobs, 113, located one at each opposite end of the former will adjust the height of the throat, or stock outlet 62. Knobs 86 and rods 85, located at spaced distances across the former, such as every twelve inches, will adjust the clearance 84 between tip 83 and surface 29 of cylinder mold 22. The hand wheels, or knobs 108, also located at spaced distances across the former, and the rods, or thrust screws 107 wil adjust the cleareance intermediate of the pressure chamber 63 at 115 to determine the pooling of the stock in the chamber.

On conventional formers the lid enclosure is of a stationary, rigid design. This rigid design usually has a determental effect on the Machine Direction shear generated in the flow under the roof of the lid by the difference in speed between the roll surface and the stationary roof causing disruption of the formed mat. The movable geometry of the lid 101 and cantilevered section at 102 constantly provides the stock suspension with a self-relieving action which automatically increases the clearance at the exit 62 of the enclosure.

This allows at times additional discharge of the undrained stock, to take place and prevents high mat stress levels from being built up under the enclosure which causes mat disruption.

We claim:

1. In combination with a cylinder mold paper making machine of the type having a flow box extending axially across the mold face thereof, the flow box having a pressure lid receiving stock from an explosion chamber, and the explosion chamber receiving stock from a manifold, the improvement comprising:

said manifold being tapered in the cross machine direction, being of rectangular cross section, and having an upstanding outer side wall obliqued to the path of incoming stock and an opposite inner side wall, said inner side wall having a predetermined pattern of outlet apertures extending therethrough from the inner face to the outer face of said side wall;

said explosion chamber being integrally formed in said flow box and juxtaposed to said inner side wall of said manifold, with the apertured outer face of said inner side wall constituting the apertured inner face of the rearward wall of said chamber;

said explosion chamber including a floor, a baffle upstanding centrally of said floor, a top wall parallel to said floor and a forward wall parallel to said rearward wall, said forward wall having a bottom outlet leading to said pressure lid;

said baffle having a rearward face extending in a vertical plane normal to the horizontal axes of the outlet apertures in said outer face of said inner side wall for increasing the target impact effect on the stock thereby improving the mixing, eddying and turbulence in said chamber;

and said pressure lid being elongated and of predetermined dimensions to extend over the mold face of said cylinder for an arc of at least about twelve inches to increase the drainage effect thereof.

2. A combination as specified in claim 1 wherein:

said pressure lid is formed in two sections hingedly connected to each other intermediate of the arc thereof, and includes control means for adjusting the tip clearance of said lid and for hinging said two sections relative to each other to vary the volume of the lid enclosure during operation of said machine.

3. A combination as specified in claim 1 wherein:

said elongated pressure lid is articulated and includes control means adjustable during operation of said machine for varying tip clearance, lid enclosure volume and enclosure inlet clearance.

4. A combination as specified in claim 1 wherein:

said inner side wall of said manifold constituting the apertured rearward wall of said explosion chamber includes apertures which are tapered from a truncated conical influent end to a cylindrical effluent end of reduced diameter.

5. A combination as specified in claim 1 wherein:

said inner side wall of said manifold constituting the apertured rearward wall of said explosion chamber includes helically rifled grooves defining said apertures.

6. A combination as specified in claim 1 wherein:

said baffle includes an upper rearward edge cut away to form a convex recess adapted to decrease eddying and increase pressure.

7. A combination as specified in claim 1 wherein:

said top wall of said explosion chamber includes a lower face which is normal to the adjacent face of said rearward wall to form a right angular corner, whereby incoming stock is impacted in a direction normal to the rearward face of said baffle and then again impacted in a direction normal to the lower face of said top wall before flowing through the restricted passage of said chamber.

8. A combination as specified in claim 1 wherein:

said elongated pressure lid is of flexible material and includes an integral upstanding flange along the rearward edge thereof, said flange being attached to said flow box with a rubber cushion to constitute a flexible hinge.

9. A combination as specified in claim 1 plus:

a flexible strip of rubber-like material extending axially across the forward lower edge of said flow box, said strip having a rearward portion with an enlarged terminal bead, or bulb, anchored in a corresponding groove in said baffle and having a forward terminal portion in tangential engagement with the face of said cylinder mold for forming the lower plate of the enclosure of said pressure lid, said strip being slidable axially out of said flow box for ready substitution or replacement.

10. A combination as specified in claim 1 wherein said machine includes a felt, a smooth faced idler roll for guiding said felt of said machine and means mounting said roll for rotation with said felt just in rear of the tip of said pressure lid.

11. The method of forming paper on a cylinder mold by means of a unitary flow box having a manifold tapered in the cross-machine direction and separated by an apertured plate from an explosion chamber, an upstanding imperforate planar baffle in said chamber, and spring leaf pressure lid with a cantilevered tip, which method comprises the steps of directing influent stock along said tapered manifold and thence through relatively short apertures in said apertured plate directly into the explosion chamber of said flow box;

then impacting said stock in a direction normal to said upstanding imperforate planar baffle and then flowing said stock upwardly along said baffle and against a wall of the explosion chamber to impact said stock perpendicularly for a second time;

then flowing said stock through a narrow passage, for development of pressure shock; and then flowing said stock through a divergent diffuser section to reform eddies and create turbulent mixing prior to delivering it through an outlet throat of the explosion chamber to said pressure lid for paper formation on said cylinder mold.

12. A method as specified in claim 11 plus the steps of establishing a predetermined lid tip clearance by the adjusting of the shape and clearances of said pressure lid at the effluent end, the intermediate portion and the influent end to control the Machine Direction-Cross Machine Direction Tensile Ratio while said paper is being formed on said cylinder mold.

13. In combination with a cylinder mold paper making machine, a cyinder mold former comprising:

a. a unitary enclosed flow box having: a manifold tapered in the cross-machine direction and separated from a juxtaposed explosion chamber by an apertured plate, said flow box having an upstanding imperforate baffle centrally of said chamber, said baffle having a vertical, rearward, planar face normal to the axes of the apertures in said plate for receiving stock normal to the plane thereof and spreading and mixing the same and a top face spaced from the roof of said chamber, and said explosion chamber including an expansion section directing stock upwardly, a narrow diffusion section directing stock forwardly over the top face of said baffle and an outwardly tapered throat directing stock downwardly and out of said flow box, and b. an elongated pressure lid of flexible, resilient spring leaf material having an upstanding integral rearward flange attached to said flow box to form a hinge therewith, and a forward, free terminal tip spaced at least a twelve inch arc from said flange to form an elongated pressure enclosure under said lid in which stock suspension received from said unitary flow box may contact the cylinder mold.

14. A cylinder mold former as specified in claim 13 wherein:

said tapered manifold is rectangular in cross section and includes a top insert plate of predetermined dimensions to establish the volume of said manifold, said insert plate being slidably removable from the large end of said manifold for remachining and replacement.

15. In combination with the foraminous moving surface of a paper making machine, a unitary enclose flow box former mounted thereon containing a manifold tapered in the cross-machine direction and delivering stock through an apertured plate perpendicularly against an upstanding imperforate baffle within an expansion chamber and through an outlet throat of the expansion chamber to a pressure lid;

said pressure lid being a flexible, resilient spring leaf material adapted to form a pressure enclosure substantially the full width of said foraminous moving surface and extending over an area of the said surface for atleast twelve inches from a forward free terminal tip to an integral upstanding rearward flange, a cantilevered forward tip end on said lid establishing a predetermined tip clearance from said surface, means for attaching said flange to said former;

and profile adjustment means including a plurality of fine threaded adjustment screws spaced across said lid and supported on said former for varying said predetermined clearance of said tip during operation of said machine.

16. A combination as specified in claim 15 wherein:

said pressure lid is hingedly connected to said former at said flange end, and at said cantilevered tip end and is formed in two sections hingedly connected intermediate of said ends and said profile adjustment means includes a set of said screws operable on said tip end, a set of said screws operable on said flange end and a set of said screws operable on said intermediate hinged connection.

17. A combination as specified in claim 15 wherein:

said profile adjustment means is hingedly connected to the flexible resilient material of said pressure lid at a spaced distance in rear of the forward, free terminal tip thereof to enable said cantilevered tip end portion at the terminal end of said lid to flex resiliently.

* * * * *